US008381810B2

(12) United States Patent
Dreher, Jr. et al.

(10) Patent No.: US 8,381,810 B2
(45) Date of Patent: Feb. 26, 2013

(54) FISHBONE WELL CONFIGURATION FOR IN SITU COMBUSTION

(75) Inventors: Wayne R. Dreher, Jr., Katy, TX (US); Partha S. Sarathi, Bartlesville, OK (US)

(73) Assignee: ConocoPhillips Company, Houston, TX (US)

( * ) Notice: Subject to any disclaimer, the term of this patent is extended or adjusted under 35 U.S.C. 154(b) by 338 days.

(21) Appl. No.: 12/882,363

(22) Filed: Sep. 15, 2010

(65) Prior Publication Data

US 2011/0067858 A1 Mar. 24, 2011

Related U.S. Application Data

(60) Provisional application No. 61/245,321, filed on Sep. 24, 2009.

(51) Int. Cl.
*E21B 43/243* (2006.01)

(52) U.S. Cl. ..... 166/245; 166/251.1; 166/256

(58) Field of Classification Search ..... 166/256, 166/261, 245, 272.2, 272.1, 272.3, 50, 251.1
See application file for complete search history.

(56) References Cited

U.S. PATENT DOCUMENTS

| | | | | |
|---|---|---|---|---|
| 1,816,260 | A * | 7/1931 | Lee | 166/303 |
| 3,354,958 | A | 11/1967 | Parker | |
| 4,498,537 | A | 2/1985 | Cook | |
| 4,557,329 | A | 12/1985 | Savard et al. | |
| 5,320,170 | A | 6/1994 | Huang et al. | |
| 5,626,191 | A | 5/1997 | Greaves et al. | |
| 6,167,966 | B1 | 1/2001 | Ayasse et al. | |
| 6,412,557 | B1 | 7/2002 | Ayasse et al. | |
| 7,387,175 | B2 | 10/2006 | Vinegar et al. | |
| 7,516,789 | B2 | 4/2009 | Chhina et al. | |
| 7,520,325 | B2 | 4/2009 | Hocking | |
| 7,581,587 | B2 * | 9/2009 | Pfefferle | 166/245 |
| 2004/0035582 | A1 * | 2/2004 | Zupanick | 166/313 |
| 2007/0023186 | A1 * | 2/2007 | Kaminsky et al. | 166/266 |
| 2008/0185145 | A1 * | 8/2008 | Carney et al. | 166/272.1 |
| 2009/0200024 | A1 * | 8/2009 | Ayasse et al. | 166/261 |

FOREIGN PATENT DOCUMENTS

WO 9421889 A1 9/1994

OTHER PUBLICATIONS

"A Miscible WAG Project Using Horizontal Wells in a Mature Offshore Carbonate Reservoir", SPE 93606, 14th SPE Middle East Oil & Gas Show and Conference Bahrain, Mar. 12-15.
"Heavy Oil Reservoirs", Oilfield Review, Autumn 2002.
Cross-SAGD (XSAGD)—"An Accelerated Bitumen Recovery Alternative", 2005 SPE International Thermal Operations and Heavy Oil Symposium Calgary, Alberta, Canada, Nov. 1-3, 2005.
"THAI™ Whitesands Experimental Pilot" CMG 2004 Technical Symposium, 2004, 32 pages.

* cited by examiner

*Primary Examiner* — David Andrews
*Assistant Examiner* — Taras P Bemko
(74) *Attorney, Agent, or Firm* — ConocoPhillips Company

(57) ABSTRACT

An underground reservoir is provided comprising an injection well and a production well. The production well has a horizontal section oriented generally perpendicularly to a generally linear and laterally extending, upright combustion front propagated from the injection well.

31 Claims, 1 Drawing Sheet

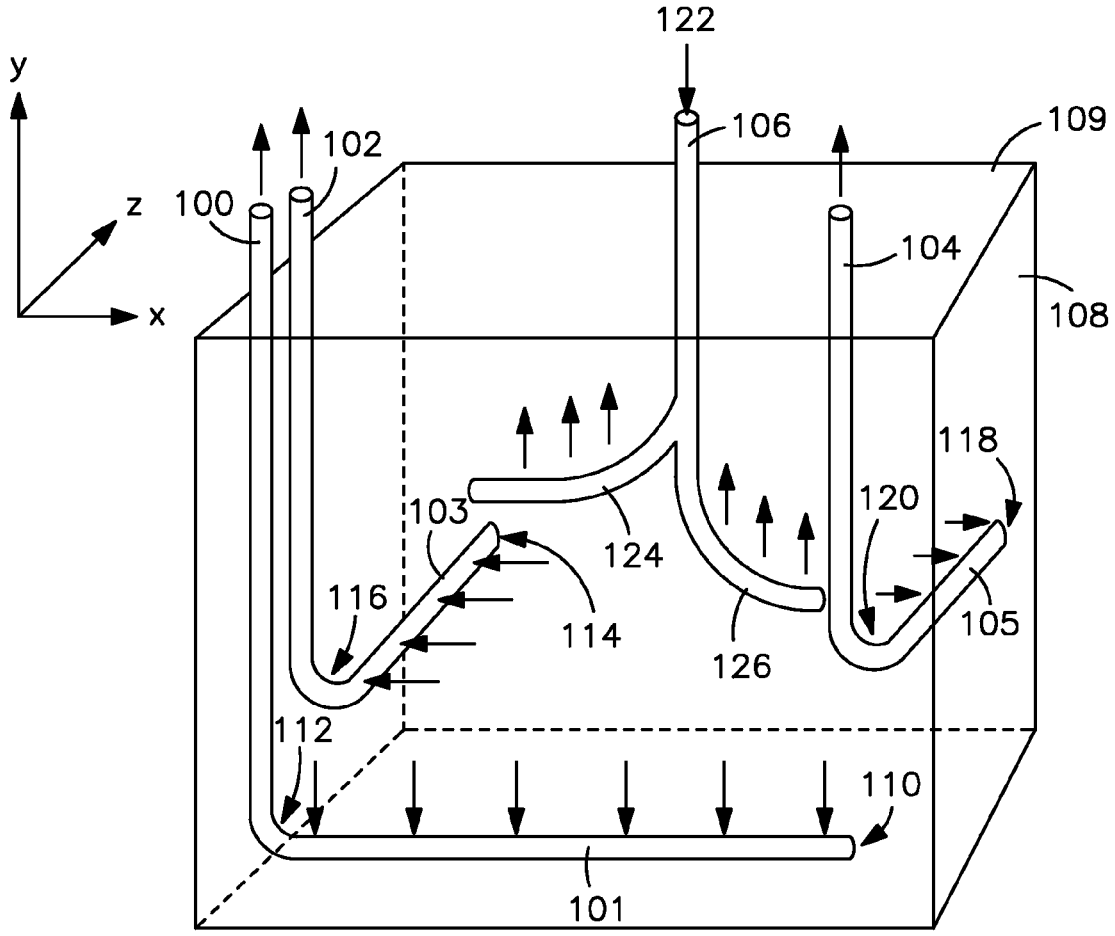
122
y
z
x
100
102
106
109
104
108
118
120
103
124
116
114
126
105
112
110
101

FISHBONE WELL CONFIGURATION FOR IN SITU COMBUSTION

CROSS-REFERENCE TO RELATED APPLICATIONS

This application claims priority benefit under 35 U.S.C. Section 119(e) to U.S. Provisional Patent Ser. No. 61/245,321 filed on Sep. 24, 2009 the entire disclosure of which is incorporated herein by reference.

FIELD OF THE INVENTION

Embodiments of the invention relate to a method for recovering hydrocarbons with in situ combustion.

BACKGROUND OF THE INVENTION

In situ combustion (ISC) processes are applied for the purpose of recovering oil from light oil, medium oil, heavy oil and bitumen reservoirs. In the process, oil is heated and displaced to an open production well for recovery. Historically, in situ combustion involves providing spaced apart vertical injection and production wells within a reservoir. Typically, an injection well will be located within a pattern of surrounding production wells. An oxidant, such as air, oxygen enriched air or oxygen, is injected through an injection well into a hydrocarbon formation, allowing combustion of a portion of the hydrocarbons in the formation in place, i.e., in-situ. The heat of combustion and the hot combustion products warm the portion of reservoir adjacent the combustion front and drive (displace) hydrocarbons toward offset production wells.

One difficulty associated with applying in situ combustion as a stand alone recovery method in heavy oil and bitumen reservoirs is the lack of mobility of the oil. For example, in situ combustion involves the injection of an oxidant into a formation. The oil in place serves as a fuel for the combustion front once ignition has occurred. As with any burning process, heat, oxygen, and fuel must be readily available to sustain combustion. In heavy oil and bitumen reservoirs this process is interrupted by the fact that the oil in the reservoir is not mobile. Therefore, combustion gas products ($CO$, $CO_2$, $H_2S$, etc.) and mobilized oil can become trapped in the reservoir which leads to the suffocation of the combustion front. Therefore, a need exists for a method of initiating enhanced communication between the injection and production wells along with a method for extracting both oil and gas from the reservoir for in situ combustion processes.

SUMMARY OF THE INVENTION

In one embodiment, a method of conducting in situ combustion in an underground reservoir, includes: forming at least one injection well disposed in the underground reservoir, wherein the injection well includes a vertically deviated well, a first horizontal injector well and a second horizontal injector well, wherein the first and second horizontal injector wells can vary from 30° to 120° from the vertically deviated well, wherein the injection well including the first and second horizontal injector wells are at least 5 meters above a hydrocarbon producing zone, wherein the distal ends of the first and second horizontal injector wells include a toe portion, wherein the opposite ends of the first and second horizontal injector wells include a heel portion, wherein the heel portions connect the first and second horizontal portions to the vertically deviated well; forming a first production well having a first substantially horizontal producer portion and a first substantially vertical producer portion disposed in the underground reservoir, wherein the distal end of the horizontal producer portion includes a toe portion, wherein the opposite end of the horizontal portion includes a heel portion, wherein the heel portion connects the first horizontal producer portion to the first vertical portion of the first production well; forming a second production well having a second substantially horizontal producer portion and a second substantially vertical producer portion disposed in the underground reservoir, wherein the distal end of the horizontal producer portion includes a toe portion, wherein the opposite end of the horizontal portion includes a heel portion, wherein the heel portion connects the second horizontal producer portion to the second vertical portion of the second production well, wherein the second production well is located lower in the reservoir than the first production well; injecting an oxidant into the injection well to establish a combustion front of ignited hydrocarbons to propagate a combustion front through the reservoir; recovering hydrocarbons from the reservoir via the second production well due to gravity drainage; and recovering combustion gas from the reservoir via the first production well.

In another embodiment, a method of conducting in situ combustion in an underground reservoir, includes: forming at least one injection well disposed in the underground reservoir, wherein the injection well includes a vertically deviated well, a first horizontal injector well and a second horizontal injector well; forming a first production well having a first substantially horizontal producer portion and a first substantially vertical producer portion disposed in the underground reservoir; forming a second production well having a second substantially horizontal producer portion and a second substantially vertical producer portion disposed in the underground reservoir; injecting an oxidant into the injection well to establish a combustion front of ignited hydrocarbons which propagate a combustion front through the reservoir; and recovering hydrocarbons through the production well.

In another embodiment, a method of conducting in situ combustion in an underground reservoir, includes: forming at least one injection well disposed in the underground reservoir, wherein the injection well includes a vertically deviated well, a first horizontal injector well and a second horizontal injector well; forming a first production well having a first substantially horizontal producer portion and a first substantially vertical producer portion disposed in the underground reservoir; forming a second production well having a second substantially horizontal producer portion and a second substantially vertical producer portion disposed in the underground reservoir; heating the reservoir surrounding the injection well, wherein the heating occurs without igniting oil in the reservoir and with operations conducted through the injection well; initiating in situ combustion after heating the reservoir, within the initiating includes injecting an oxidant into the injection well to establish a combustion front of ignited hydrocarbons which propagate a combustion front through the reservoir; and recovering hydrocarbons through the production well.

BRIEF DESCRIPTION OF THE DRAWINGS

The invention, together with further advantages thereof, may best be understood by reference to the following description taken in conjunction with the accompanying drawings in which:

FIG. 1 is a schematic section of an injection well and a series of production wells according to an embodiment of the present invention.

DETAILED DESCRIPTION OF THE INVENTION

Reference will now be made in detail to embodiments of the present invention, one or more examples of which are illustrated in the accompanying drawing. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the appended claims and their equivalents.

Referring to FIG. 1, an underground reservoir 108 contains an injection well 106 and a series of production wells 100, 102, 104 disposed therein. The "x-axis" is parallel to the earth surface 109. The "y-axis" is orthogonal to the x-axis and vertical to the earth surface 109. The "z-axis" is orthogonal to both the x-axis and the y-axis.

The injection well 106 is a single well with a vertically deviated well from the surface, i.e., along the y-axis, with multiple wells at angles varying from 30° to 120° from the vertically drilled well into the reservoir along the x-axis and/or the y-axis and/or the z-axis. The configuration of the injection well is similar to a fishbone configuration. Depicted in FIG. 1, the injection well defines a first horizontal injector well 124 and a second horizontal injector well 126. The first and second horizontal injector wells 124 and 126, respectively, may progress through the reservoir at angles which differ from the original angle facilitating the best placement of the well within the reservoir. In an embodiment, the injection well may contain multiple horizontal injector wells. Furthermore, the horizontal injector portions 124 and 126 increase potential area for communication between the injection well 106 and the production wells relative to only utilizing vertical injection wells where lateral area for establishing communication is limited. The injection well 106 along with the first horizontal injector well 124 and second horizontal injector well 126 are at least 5 meters above the bottom pay zone.

The reservoir 108 contains at least two production wells each having a vertical producer portion and a substantially horizontal producer portion completed via horizontal drilling techniques known in the art. The horizontal producer portions of the production wells can be placed at the base of the reservoir pay zone, where at least one or more of the horizontal producer portions are arranged parallel or perpendicular to one or more of the horizontal producer portions situated vertically beneath the other wells. In an embodiment, as depicted in FIG. 1, the reservoir contains two horizontal producer wells 103 and 105 situated along the z-axis above a single perpendicular horizontal producer well 101 situated along the x-axis.

The production wells 100, 102, 104 have the general shape of a foot, and are defined by a "toe" portion 110, 114, 118 and a "heel" portion 112, 116, 120. The toe portion is located at the distal end of the horizontal producer portion, while the heel portion is located at the intersection of the horizontal producer portion and vertical producer portion. The production wells contain slots at various desired locations along the horizontal producer portion to facilitate production of fluids from the reservoir. The slots are narrowly cut either axially or transversely in the wall of the horizontal producer portion. The slots are made sufficiently narrow to exclude particles greater than a selected size, while allowing flow into or out of the wellbore. The number of slotted wall sections, the size of the slots, and the location of the slots are solely dependent on operational requirements and desires.

In situ combustion cannot be applied directly to an immobile reservoir without prior stimulation due to inadequate initial communication between the injection well and the production well. The cold heavy oil and/or bitumen in the formation cause this lack of communication resulting in an inability to produce combustion gas products or mobile oil from the reservoir. The inability to vacate the products from the reservoir ultimately results in the suffocation of the combustion front and termination of the process. Cyclic steam stimulation (CSS), also known as the huff-and-puff method, is typically applied to heavy-oil reservoirs to boost recovery and can ultimately initiate the required communication between the injection and production wells. During the primary production phase, the cyclic steam stimulation method assists natural reservoir energy by melting the oil so it will more easily move through the formation.

Preheating the formation 108 around the fishbone injection well configuration 106 with steam, for example, may facilitate in establishing initial communication between the fishbone injection well configuration 106 and the production wells 100, 102, 104. In an embodiment of the huff-and-puff method, a predetermined amount of steam is injected into the fishbone injection well configuration, which has been drilled or converted for injection purposes. In another embodiment, a predetermined amount of steam is injected into the fishbone injection well configuration and one or more of the injection wells. In another embodiment, a predetermined amount of steam is injected into one or more of the injection wells. Once the pay zone between the wells has been heated (>90° F.), the well is then shut in to allow the steam to heat or "soak" the producing formation around the well. After a sufficient time has elapsed to allow adequate heating, the injection well is back in production until the heat is dissipated with the production fluids. The huff phase (steam injection), the soak phase, and the puff phase (production phase) are repeated as necessary to heat the formation around the fishbone injection well configuration and to establish fluid communication between the injection well and the production wells for in situ combustion.

Once communication is established, the in situ combustion process may begin. In operation, the in situ combustion process begins with the injection of an oxidant 122 through the injection well 106 to initiate combustion. Air is usually used; however it may be substituted directly with oxygen or with recycled gases enriched with oxygen. Water may also be injected continuously or as slugs along with an oxidant to improve the combustion process. Continuous gas injection and cold water circulation in the injection well can be used to minimize combustion damage to the well.

The major driver for recovery of oil through the combustion process will be gravity drainage. For example, as the combustion front propagates from the injection well at the top of the formation, oil and gas drain to the base of the reservoir. Specifically, combustion is initiated and maintained by the injection of an oxygen containing gas at the top of the reservoir into the injection well 106, with mobilized oil draining to lower horizontal producer wells, i.e., 101, 103, 105.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described in the present invention. It is the intent of the inventors that variations and equivalents of the invention are within the scope of the claims below and the description, abstract and drawings not to be used to limit the scope of the invention.

The invention claimed is:

1. A method of conducting in situ combustion in an underground reservoir, comprising:

a. forming at least one injection well disposed in the underground reservoir between first and third production wells, wherein the injection well is vertically deviated with a first horizontal injector well portion extending toward the first production well and a second horizontal injector well portion extending toward the third production well, wherein the first and second horizontal injector well portions can vary from 30° to 120° from vertical and thereby provide lateral area coverage that facilitates establishing communication with the first and third production wells for beginning the in situ combustion, wherein the distal ends of the first and second horizontal injector well portions include a toe portion, wherein the opposite ends of the first and second horizontal injector well portions include a heel portion, wherein the heel portions connect the first and second horizontal injector well portions to where the injection well is vertically deviated;

b. forming the first production well having a first substantially horizontal producer portion and a first substantially vertical producer portion disposed in the underground reservoir, wherein the distal end of the horizontal producer portion includes a toe portion, wherein the opposite end of the horizontal portion includes a heel portion, wherein the heel portion connects the first horizontal producer portion to the first vertical portion of the first production well;

c. forming a second production well having a second substantially horizontal producer portion and a second substantially vertical producer portion disposed in the underground reservoir, wherein the distal end of the horizontal producer portion includes a toe portion, wherein the opposite end of the horizontal portion includes a heel portion, wherein the heel portion connects the second horizontal producer portion to the second vertical portion of the second production well, wherein the second production well is located lower in the reservoir than the first production well;

d. forming the third production well having a third substantially horizontal producer portion and a third substantially vertical producer portion disposed in the underground reservoir, wherein the distal end of the horizontal producer portion includes a toe portion, wherein the opposite end of the horizontal portion includes a heel portion, wherein the heel portion connects the third horizontal producer portion to the third vertical portion of the third production well;

e. injecting an oxidant into the injection well to establish a combustion front of ignited hydrocarbons to propagate a combustion front through the reservoir;

f. recovering hydrocarbons from the reservoir via the second production well due to gravity drainage; and g. recovering combustion gas from the reservoir via the first and third production wells.

2. The method according to claim 1, further comprising injecting steam into the injection well prior to injecting the oxidant into the injection well and igniting hydrocarbons in the reservoir.

3. The method according to claim 1, wherein the oxidant is air.

4. The method according to claim 1, wherein the oxidant is oxygen.

5. The method according to claim 1, wherein the oxidant is recycled gas enriched with oxygen.

6. A method of conducting in situ combustion in an underground reservoir, comprising:

a. forming at least one injection well disposed in the underground reservoir, wherein the injection well is vertically deviated with a first horizontal injector well portion and a second horizontal injector well portion;

b. forming a first production well having a first substantially horizontal producer portion and a first substantially vertical producer portion disposed in the underground reservoir;

c. forming a second production well having a second substantially horizontal producer portion and a second substantially vertical producer portion disposed in the underground reservoir, wherein the injection well is disposed between the first and second production wells with the first horizontal injector well portion extending toward the first substantially horizontal producer portion and the second horizontal injector well portion extending toward the second substantially horizontal producer portion;

d. injecting an oxidant into the injection well to establish a combustion front of ignited hydrocarbons which propagate a combustion front through the reservoir;

e. recovering hydrocarbons through the production wells; and f. further comprising a third production well located lower in the reservoir than the first and second production wells.

7. The method according to claim 6, wherein the first and second horizontal injector well portions are between 30° to 120° from vertical.

8. The method according to claim 6, wherein the injection well including the first horizontal injector well portion and the second horizontal injector well portion are at least 5 meters above a hydrocarbon producing zone.

9. The method according to claim 6, wherein the distal ends of the first and second horizontal injector well portions include a toe portion, wherein the opposite ends of the first and second horizontal injector well portions include a heel portion, wherein the heel portions connect the first and second horizontal injector well portions to where the injection well is vertically deviated.

10. The method according to claim 6, wherein the distal end of the first horizontal producer portion includes a toe portion, wherein the opposite end of the first horizontal portion includes a heel portion, wherein the heel portion connects the first horizontal producer portion to the first vertical portion of the first production well.

11. The method according to claim 6, wherein the distal end of the second horizontal producer portion includes a toe portion, wherein the opposite end of the second horizontal portion includes a heel portion, wherein the heel portion connects the second horizontal producer portion to the second vertical portion of the second production well.

12. The method according to claim 6, wherein the hydrocarbons from the underground reservoir exit the reservoir through the production wells due to gravity drainage.

13. The method according to claim 6, wherein the gases from the underground reservoir exit the reservoir via the first and second production wells as the hydrocarbons are produced through the third production well.

14. The method according to claim 6, further comprising injecting steam into the injection well prior to injecting the oxidant into the injection and/or producer well(s) and igniting hydrocarbons in the reservoir.

15. The method according to claim 6, wherein the oxidant is air.

16. The method according to claim 6, wherein the oxidant is oxygen.

17. The method according to claim 6, wherein the oxidant is recycled gas enriched with oxygen.

18. A method of conducting in situ combustion in an underground reservoir, comprising:

a. forming at least one injection well disposed in the underground reservoir, wherein the injection well is vertically deviated with a first horizontal injector well portion and a second horizontal injector well portion;

b. forming a first production well having a first substantially horizontal producer portion and a first substantially vertical producer portion disposed in the underground reservoir;

c. forming a second production well having a second substantially horizontal producer portion and a second substantially vertical producer portion disposed in the underground reservoir, wherein the injection well is disposed between the first and second production wells with the first horizontal injector well portion extending toward the first substantially horizontal producer portion and the second horizontal injector well portion extending toward the second substantially horizontal producer portion;

d. heating the underground reservoir to establish communication between the injection and production wells due to proximity of the horizontal injector portions to the horizontal producer portions along with lateral area coverage of the injection well, wherein the heating occurs without igniting hydrocarbons in the reservoir;

e. initiating in situ combustion after heating the reservoir, wherein the initiating includes injecting an oxidant into the injection well to establish a combustion front of ignited hydrocarbons;

f. recovering hydrocarbons through the production well; and g. further comprising a third production well located lower in the reservoir than the first and second production wells.

19. The method according to claim 18, wherein the first and second horizontal injector well portions are between 30° to 120° from vertical.

20. The method according to claim 18, wherein the injection well including the first horizontal injector well portion and the second horizontal injector well portion are at least 5 meters above a hydrocarbon producing zone.

21. The method according to claim 18, wherein the distal ends of the first and second horizontal injector well portions include a toe portion, wherein the opposite ends of the first and second horizontal injector well portions include a heel portion, wherein the heel portions connect the first and second horizontal portions to where the injection well is vertically deviated.

22. The method according to claim 18, wherein the distal end of the horizontal producer portion includes a toe portion, wherein the opposite end of the horizontal portion includes a heel portion, wherein the heel portion connects the first horizontal producer portion to the first vertical portion of the first production well.

23. The method according to claim 18, wherein the distal end of the horizontal producer portion includes a toe portion, wherein the opposite end of the horizontal portion includes a heel portion, wherein the heel portion connects the second horizontal producer portion to the second vertical portion of the second production well.

24. The method according to claim 18, wherein the hydrocarbons from the reservoir exit the reservoir through the production wells due to gravity drainage.

25. The method according to claim 18, wherein the gases from the reservoir exit the reservoir via the first and second production wells as the hydrocarbons are produced through the third production well.

26. The method according to claim 18, wherein the oxidant is air.

27. The method according to claim 18, wherein the oxidant is oxygen.

28. The method according to claim 18, wherein the oxidant is recycled gas enriched with oxygen.

29. The method according to claim 18, wherein step (d) occurs through the injection well.

30. The method according to claim 18, wherein step (d) occurs through the injection well and the production wells.

31. The method according to claim 18, wherein step (d) occurs through the production wells.

* * * * *